US010889777B2

(12) United States Patent
Hutchison

(10) Patent No.: US 10,889,777 B2
(45) Date of Patent: Jan. 12, 2021

(54) SYNTHETIC LUBRICATING OIL COMPOSITIONS

(71) Applicant: PHILLIPS 66 COMPANY, Houston, TX (US)

(72) Inventor: Gregory S. Hutchison, Tulsa, OK (US)

(73) Assignee: Phillips 66 Company, Houston, TX (US)

( * ) Notice: Subject to any disclaimer, the term of this patent is extended or adjusted under 35 U.S.C. 154(b) by 0 days.

(21) Appl. No.: 15/290,285

(22) Filed: Oct. 11, 2016

(65) Prior Publication Data

US 2017/0107439 A1 Apr. 20, 2017

Related U.S. Application Data

(60) Provisional application No. 62/242,009, filed on Oct. 15, 2015.

(51) Int. Cl.

| | |
|---|---|
| ***C10M 111/04*** | (2006.01) |
| ***C10N 30/02*** | (2006.01) |
| ***C10N 30/04*** | (2006.01) |
| ***C10N 30/06*** | (2006.01) |
| ***C10N 30/08*** | (2006.01) |
| ***C10N 30/10*** | (2006.01) |
| ***C10N 30/12*** | (2006.01) |
| ***C10N 30/18*** | (2006.01) |
| ***C10N 40/12*** | (2006.01) |

(52) U.S. Cl.

CPC ... *C10M 111/04* (2013.01); *C10M 2205/0206* (2013.01); *C10M 2205/0285* (2013.01); *C10M 2205/223* (2013.01); *C10M 2207/0406* (2013.01); *C10M 2209/1033* (2013.01); *C10M 2209/1045* (2013.01); *C10N 2030/02* (2013.01); *C10N 2030/04* (2013.01); *C10N 2030/06* (2013.01); *C10N 2030/08* (2013.01); *C10N 2030/10* (2013.01); *C10N 2030/12* (2013.01); *C10N 2030/18* (2013.01); *C10N 2040/12* (2013.01)

(58) Field of Classification Search

CPC ..... C10M 111/04; C10M 2205/0206; C10M 2205/0285; C10M 2205/223; C10M 2207/0406; C10M 2209/1033; C10M 2209/1045; C10N 2030/02; C10N 2030/04; C10N 2030/06; C10N 2030/08; C10N 2030/10; C10N 2030/12; C10N 2030/18; C10N 2040/12

USPC ..... 508/221

See application file for complete search history.

(56) References Cited

U.S. PATENT DOCUMENTS

| | | | | |
|---|---|---|---|---|
| 6,127,324 | A | 10/2000 | Tolfa et al. | |
| 7,732,389 | B2 | 6/2010 | Sullivan et al. | |
| 8,535,514 | B2 | 9/2013 | Carey et al. | |
| 2013/0252863 | A1 * | 9/2013 | Cooper | C10M 141/08 508/273 |

FOREIGN PATENT DOCUMENTS

| | | | | |
|---|---|---|---|---|
| EP | 0796908 | | 9/1997 | |
| WO | WO 2011011656 | A2 * | 1/2011 | C10M 107/34 |
| WO | WO-2014172125 | A1 * | 10/2014 | C10M 161/00 |

OTHER PUBLICATIONS

Understanding the Differences in Base Oil Groups, retrieved from the internet at <http://www.machinerylubrication.com/Read/29113/base-oil-groups> on May 21, 2018.*

* cited by examiner

*Primary Examiner* — James C Goloboy

(74) *Attorney, Agent, or Firm* — Phillips 66 Company

(57) ABSTRACT

A lubricating base stock comprising an alkyl aromatic, a blend of additives, a blend of oil soluble polyalkylene glycols and a blend of polyolefins. In the lubricating base stock, the blend of polyolefins comprises at least one metallocene polyolefin.

18 Claims, No Drawings

SYNTHETIC LUBRICATING OIL COMPOSITIONS

CROSS-REFERENCE TO RELATED APPLICATIONS

This application is a non-provisional application which claims the benefit of and priority to U.S. Provisional Application Ser. No. 62/242,009 filed Oct. 15, 2015, entitled "Synthetic Lubricating Oil Compositions," which is hereby incorporated by reference in its entirety.

STATEMENT REGARDING FEDERALLY SPONSORED RESEARCH OR DEVELOPMENT

None

FIELD OF THE INVENTION

This invention relates to synthetic lubricating oil compositions.

BACKGROUND OF THE INVENTION

Lubricating oils have been used in the past to lubricate the bearings of positive displacement compressors, to seal the rotors, and to cool the compressed gases. Lubricating oils typically used in the industry comprise a mineral oil or synthetic oil as a base oil, and various additives for a particular purpose. Oxidation stability and varnish and deposit control are some of the important properties desirable in a lubricant for maximizing—the life of the lubricant, and hence, the life of the equipment, especially under the high temperature and pressure conditions created when operating turbines.

It has also been desirable in the industry to provide a lubricating composition which does not deteriorate due to high temperatures. Thermal stability of a lubricating oil is therefore sought after.

There exists a need to increase the oxidation stability of a turbine fluid while providing increased solvency to hold the oil degradation by-products in suspension preventing the formation of varnish and sludge in the oil system.

BRIEF SUMMARY OF THE DISCLOSURE

A lubricating base stock comprising an alkyl aromatic, a blend of additives, a blend of oil soluble polyalkylene glycols and a blend of polyolefins. In the lubricating base stock, the blend of polyolefins comprises at least one metallocene polyolefin.

In another embodiment, a lubricating base stock is described comprising an alkyl aromatic ranging from about 50 wt % to about 95 wt %, a blend of additives ranging from about 0.005 wt % to about 5 wt %, a blend of oil soluble polyalkylene glycols ranging from about 5 wt % to about 50 wt %, and a blend of polyalphaolefins ranging from about 10 wt % to about 20 wt %. In the lubricating base stock, then the blend of polyalphaolefins comprises at least two different types of polyalphaolefins comprising: at least one metallocene polyalphaolefin.

A method of manufacturing a lubricating base stock comprising the mixing of an alkyl aromatic, a blend of oil soluble polyalkylene glycols a blend of additives and a blend of polyolefins. In this method of manufacture the blend of polyolefins comprise at least one metallocene polyolefin.

A method of manufacturing a lubricating base stock comprising the mixing of an alkyl aromatic ranging from about 50 wt % to about 95 wt %, a blend of additives ranging from about 0.005 wt % to about 5 wt %, a blend of oil soluble polyalkylene glycols ranging from about 5 wt % to about 50 wt %, and a blend of polyalphaolefins ranging from about 10 wt % to about 20 wt %. In this method of manufacture, the blend of polyalphaolefins comprises at least two different types of polyalphaolefins comprising: at least one metallocene polyalphaolefin.

BRIEF DESCRIPTION OF THE DRAWINGS

A more complete understanding of the present invention and benefits thereof may be acquired by referring to the follow description taken in conjunction with the accompanying drawings in which:

None

DETAILED DESCRIPTION

Turning now to the detailed description of the preferred arrangement or arrangements of the present invention, it should be understood that the inventive features and concepts may be manifested in other arrangements and that the scope of the invention is not limited to the embodiments described or illustrated. The scope of the invention is intended only to be limited by the scope of the claims that follow.

The present embodiment describes a lubricating base stock comprising an alkyl aromatic, a blend of additives, and a blend of oil soluble polyalkylene glycols and a blend of polyolefins. In the lubricating base stock, the blend of polyolefins comprises at least one metallocene polyolefin.

Alkyl Aromatic

In one embodiment, the alkyl aromatics used can have a kinematic viscosity at 40° C. of about 5 cSt to about 800 cSt, preferably from about 15 to about 500 cSt, and most preferably from about 15 cSt to about 220 cSt, and are selected from alkyl benzenes, alkyl naphthalenes, alkyl anthracenes, and alkyl phenanthrenes, or mixtures thereof. Commercially available examples of such alkyl aromatics are RF 150® and RF 300®, available at Soltex, and Zerol 150®, Zerol 300®, and Zerol 500®, available at Shrieve Chemical. The preferred alkyl aromatics are alkyl naphthalenes. Commercially available examples of such alkyl naphthalenes are MCP 917® and MCP-968®, available at Mobil Chemical.

In one embodiment, the alkyl aromatic is one formed from alkylating agents having from 1 to about 6 carbon atoms, preferably from 1 to about 12 carbon atoms, and most preferably from 1 to about 24 carbon atoms. In another embodiment, the alkyl aromatic used in the basestock is mono or di alkylated with an alkylating agent, forming an alkyl aromatic having one or more alkyl groups having from about 6 to about 30 carbons, and having a kinematic viscosity at 40° C. of about 15 cSt to about 500 cSt. An example of alkyl naphthalene is one that has been mono or di alkylated with an alkylating agent, and having from about 10 to about 20 carbon atoms and a kinematic viscosity at 40° C. of from about 15 cSt to about 220 cSt.

Additives

The lubricating basestock may also contain effective amounts of additives such as antioxidants, rust and corrosion inhibitors, antiwear, extreme pressure, demulsifiers, metal deactivators, lubricity additives, antiwear additives, or such additives as may be required. Commercially available examples of antiwear additives are additives such as tricresyl phosphate (TCP) available at Syn-O-Add, 8484® available at Akzo-Nobel, or triphenyl phosphorothionate (TPPT) available at Ciba Geigy. In general, the finished lubricant composition will contain the additive components in minor amounts sufficient to improve the performance characteristics and properties of the oil of lubricating viscosity or basestock blend, or to both the base oil and basestock blend. The amounts of the respective components may vary in accordance with such factors as the type and characteristics of the base oil or basestock blend employed, the type and severity of the service conditions for which the finished product is intended, for example, for use in a positive displacement compressor, such as a rotary screw compressor, a reciprocating rotary vane, or scroll, and the specific performance properties desired in the finished product. In one embodiment, the lubricating composition consists essentially of a blend of (A) at least antioxidant and (B) at least one corrosion inhibitor, having excellent oxidation stability and thermal stability, and exhibiting excellent demulsibility and hydrolytic stability, particularly under high temperature and pressure conditions.

Examples of useful antioxidants include phenyl naphthyl amines (alpha and/or beta), diphenyl amines, including alkylated diphenyl amines. Commercially available examples of such antioxidants are Irganox L-57® (available at Ciba Geigy, and Valube 81® (available at Vanderbilt Chemical). Suitable antioxidants can also include phenolic antioxidants, aromatic amine antioxidants, sulfurized phenolic antioxidants, and organic phosphites, among others. Examples of the phenolic antioxidants include 2,6-di-tert-butylphenol, liquid mixtures of tertiary butylated phenols, 2,6-di-tert-butyl-4-methylphenol, 4,4'-methylenebis(2,6-di-tert-butylphenol), 2,2'-methylenebis(4-methyl-6-tert-butylphenol), mixed methylene-bridged polyalkyl phenols, and 4,4'-thiobis(2-methyl-6-tert-butylphenol). N,N'-Di-see-butyl-p-phenylenediamine, 4-isopropylaminodiphenyl amine, phenyl-alpha-naphthyl mine, phenyl-beta-naphthyl amine, and ring-alkylated diphenylamines serve as examples of aromatic amine antioxidants. Available antioxidants that can be useful also include Ethanoxo® 702 available at the Ethyl Corporation, Irganox® L-135 and Irganox® L-118, Irganox L-06® available at Ciba Geigy, and RC-7130® available at Rhein Chemie.

Examples of suitable rust and corrosion inhibitors are neutral metal sulfonates such as calcium sulfonate, magnesium sulfonate, sodium sulfonate, barium dinonylnaphthalene sulfonate, and calcium petroleum sulfonate. Other types of rust or corrosion inhibitors which may be used comprise monocarboxylic acids and polycarboxylic acids. Examples of suitable monocarboxylic acids are oleic acids, octanoic acid, decanoic acid and dodecanoic acid. Suitable polycarboxylic acids include dimer and trimer acids such as are produced from such acids as tall oil fatty acids, oleic acid, and linoleic acid. Also useful are carboxylic acid based, metal free materials, such as hydroxy alkyl carboxylic esters. Another useful type of rust inhibitor for use in the practice of this invention is comprised of the alkenyl succinic acid and alkenyl succinic anhydride corrosion inhibitors such as, for example, tetrapropenylsuccinic acid, tetrapropenylsuccinic anhydride, tetradecenylsuccinic acid, tetradecenylsuccinic anhydride, hexadecenylsuccinic acid, hexadecenylsuccinic anhydride, and the like. Also useful are the half esters of alkenyl succinic acids having about 8 to about 24 carbon atoms in the alkenyl group with alcohols such as the polyglycols. Other suitable rust or corrosion inhibitors include ether amines; acid phosphates; amines; polyethoxylated compounds such as ethoxylated amines, ethoxylated phenols, and ethoxylated alcohols; imidazolines; and aminosuccinic acids or derivatives thereof. Mixtures of such rust or corrosion inhibitors can be used. U.S. Pat. No. 5,773,393 is incorporated in its entirety herein for its disclosure regarding rust and corrosion inhibitor additives. A commercially available example of a corrosion inhibitor is L-859® available at the Lubrizol Corporation.

Examples of suitable metal deactivators are complex organic nitrogen, oxygen and sulfur-containing compounds. For copper, compounds such as substituted benzotriazole, alkyl or acyl substituted 5,5'-methylene-bis-benzotriazole, alkyl or acyl substituted 2,5-dimercaptothiazole, salts of salicylaminoguanidine, and quinizarin are useful. Propylgallate is an example of a metal deactivator for magnesium, and sebacic acid is an example of a deactivator for lead. A commercially available example of a triazole metal deactivator is Irgamet 39® available at Ciba Geigy.

Examples of metal detergents that can be used include: sulfurized or unsulfurized alkyl or alkenyl phenates, alkyl or alkenyl aromatic sulfonates, sulfurized or unsulfurized metal salts of multi-hydroxy alkyl or alkenyl aromatic compounds, alkyl or alkenyl hydroxy aromatic sulfonates, sulfurized or unsulfurized alkyl or alkenyl naphthenates, metal salts of alkanoic acids, metal salts of an alkyl or alkenyl multi-acid, metal salts of an alkyl salicylic acid, carboxylates, overbased detergents and chemical and physical mixtures thereof.

Examples ashless dispersants that can be used include: alkenyl succinimides, alkenyl succinimides modified with other organic compounds, and alkenyl succinimides modified with boric acid, alkenyl succinic ester.

Examples of oxidation inhibitors that can be used include: 4,4'-methylenebis (2,6-di-tertbutylphenol), 4,4'-bis(2,6-di-tert-butylphenol), 4,4'-bis(2-methyl-6-tert-butylphenol), 2,2'-(methylene bis (4-methyl-6-tert-butyl-phenol), 4,4'-butylidenebis(3-methyl-6-tert-butylphenol), 4,4'-isopropylidenebis(2,6-di-tert-butyl phenol), 2,2'-methylenebis(4-methyl-6-nonylphenot), 2,2'-isobutylidene-bis(4,6-dimethylphenol), 2,2'-methylenebis(4-methyl-6-cyclohexylphenol), 2,6-di-tert-butyl-4-methyl-phenol, 2,6-di-tert-butyl-4-ethylphenol, 2,4-dimethyl-6-tert-butylphenol, 2,6-di-tert-4-(N,N' dimethylaminomethylphenol), 4,4'-thiobis(2-methyl-6-tert-butylphenol), 2,2'-thiobis(4-methyl-6-tert-butylphenol), bis(3-methy)-4-hydroxy-5-tert-butylbenzyl)-sulfide, bis (3,5-di-tert-butyl-4-hydroxybenzyl), alkylated diphenylamine, phenyl-I-naphthylamine, alkylated I-naphthylamine, metal dithiocarbamate (e.g., zinc dithiocarbamate), and methylene bis (dibutyl dithio carbamate).

Examples of rust inhibitors that can be used include: nonionic polyoxyethylene surface active agents: polyoxyethylene lauryl ether, polyoxyethylene higher alcohol ether, polyoxyethylene nonylphenyl ether, polyoxyethylene octylphenyl ether, polyoxyethylene octyl stearyl ether, polyoxyethylene oleyl ether, polyoxyethylene sorbitol monostearate, polyoxyethylene sorbitol mono-oleate, polyethylene glycol monooleate, stearic acid and other fatty acids, dicarboxylic acids, metal soaps, fatty acid amine salts, metal salts of heavy sulfonic acid, partial carboxylic acid ester of polyhydric alcohol, and phosphoric ester.

Examples of demulsifiers that can be used include: addition products of alkylphenol and ethylene oxide, polyoxyethylene alkyl ether, and polyoxyethylene sorbitan ester.

Examples of friction modifiers that can be used include: fatty alcohol, fatty acid, amine, borated ester, and other esters.

Examples of viscosity index improvers that can be used include: polymethacrylate type polymers, ethylenepropylene copolymers, styrene-isoprene copolymers, hydrated styrene-isoprene copolymers, polyisobutylene, and dispersant type viscosity index improvers.

Examples of pour point inhibitors that can be used include: polymethyl methacrylate.

Examples of foam inhibitors that can be used include: alkyl methacrylate polymers and dimethyl silicone polymers.

Polyolefins

The polyolefin used in this embodiment can be any of a class of polymers produced from a simple olefin (general formula CnH2n) as a monomer. Examples of polyolefins used can be oil soluble polyolefins or metallocene polyolefins.

In one embodiment, the specific type of polyolefins used is polyalpha-olefins (PAO) or metallocene poly-alpha-olefins (mPAO).

PAO

In one embodiment, the PAO's can be chosen from any component from a conventional linear alpha-olefin (LAO) production facility or from refinery. It can be used alone to make homo-polymer or together with another LAO available from refinery or chemical plant, including propylene, 1-butene, 1-pentene, and the like, or with 1-hexene or 1-octene made from dedicated production facility. In another embodiment, the alpha-olefins can be chosen from the alpha-olefins produced from Fischer-Trosch synthesis. For example, C3 to C16-alpha-olefins, more preferably linear alpha-olefins, are suitable to make homo-polymers. Other combinations, such as C4 and C14-LAO; C6 and C16-LAO; C8, C10, C12-LAO; or C8 and C14-LAO; C6, C10, C14-LAO; C4 and C12-LAO, etc. are suitable to make copolymers.

In another embodiment, any of the PAOs produced herein preferably have a bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the PAOs produced herein are hydrogenated and have a bromine number of 1.8 or less as measured by ASTM D 1159, preferably 1.7 or less, preferably 1.6 or less, preferably 1.5 or less, preferably 1.4 or less, preferably 1.3 or less, preferably 1.2 or less, preferably 1.1 or less, preferably 1.0 or less, preferably 0.5 or less, preferably 0.1 or less.

In another embodiment, any of the PAOs described herein may have monomer units represented by the formula, in addition to the all regular 1,2-connection.

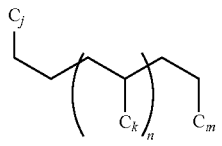

where j, k and m are each, independently, 3, 4, 5, 6, 7, 8, 9, 10, 11, 12, 13, 14, 15, 16, 17, 18, 19, 20, 21, or 22, n is an integer from 1 to 350 (preferably 1 to 300, preferably 5 to 50) as measured by proton NMR.

In another embodiment, any of the PAOs described herein preferably have an Mw (weight average molecular weight) of 100,000 or less, preferably between 100 and 80,000, preferably between 250 and 60,000, preferably between 280 and 50,000, preferably between 336 and 40,000 g/mol.

In another embodiment, any of the PAOs described herein preferably have a Mn (number average molecular weight) of 50,000 or less, preferably between 200 and 40,000, preferably between 250 and 30,000, preferably between 500 and 20,000 g/mol.

In another embodiment, any of the PAOs described herein preferably have a molecular weight distribution (MWD=Mw/Mn) of greater than 1 and less than 5, preferably less than 4, preferably less than 3, preferably less than 2.5. Alternately any of the PAOs described herein preferably have an Mw/Mn of between 1 and 2.5, alternately between 1 and 3.5, depending on fluid viscosity.

The Mw, Mn and Mz are measured by GPC method using a column for medium to low molecular weight polymers, tetrahydrofuran as solvent and polystyrene as calibration standard, correlated with the fluid viscosity according to a power equation.

In a preferred embodiment of this invention, any PAO described herein may have a pour point of less than 0° C. (as measured by ASTM D 97), preferably less than −10° C., preferably less than −20° C., preferably less than −25° C., preferably less than −30° C., preferably less than −35° C., preferably less than −50°, preferably between −10 and −80° C., preferably between −15° C. and −70° C.

In one embodiment the PAO described herein may have a kinematic viscosity (at 40° C. as measured by ASTM D 445) from about 4 to about 50,000 cSt, preferably from about 5 cSt to about 30,000 cSt at 40° C., alternately from about 4 to about 100,000 cSt, preferably from about 6 cSt to about 50,000 cSt, preferably from about 10 cSt to about 30,000 cSt at 40° C.

In another embodiment, any PAOs described herein may have a kinematic viscosity at 100° C. from about 1.5 to about 5,000 cSt, preferably from about 2 to about 3,000 cSt, preferably from about 3 cSt to about 1,000 cSt, more preferably from about 4 cSt to about 1,000 cSt, and yet more preferably from about 8 cSt to about 500 cSt as measured by ASTM D445. The PAOs preferably have viscosities in the range of 2 to 500 cSt at 100° C. in one embodiment, and from 2 to 3000 cSt at 100° C. in another embodiment, and from 3.2 to 300 cSt in another embodiment. Alternately, the PAOs has a KV100 of less than 200 cSt.

In another embodiment, any PAO described herein may have a kinematic viscosity at 100° C. from 3 to 10 cSt and a flash point of 150° C. or more, preferably 200° C. or more (as measured by ASTM D 56).

In another embodiment, any PAO described herein may have a dielectric constant of 2.5 or less (1 kHz at 23° C. as determined by ASTM D 924).

In another embodiment, any PAO described herein may have a specific gravity of 0.75 to 0.96 g/cm$^3$, preferably 0.80 to 0.94 g/cm$^3$.

In another embodiment, any PAO described herein may have a viscosity index (VI) of 100 or more, preferably 120 or more, preferably 130 or more, alternately, form 120 to 450, alternately from 100 to 400, alternately from 120 to 380, alternately from 100 to 300, alternately from 140 to 380, alternately from 180 to 306, alternately from 252 to 306, alternately the viscosity index is at least about 165, alternately at least about 187, alternately at least about 200, alternately at least about 252. For many lower viscosity fluids made from 1-decene or 1-decene equivalent feeds (KV100° C. of 3 to 10 cSt), the preferred VI range is from 100 to 180. Viscosity index is determined according to ASTM Method D 2270-93 [1998].

All kinematic viscosity values reported for fluids herein are measured at 100° C. unless otherwise noted. Dynamic viscosity can then be obtained by multiplying the measured kinematic viscosity by the density of the liquid. The units for kinematic viscosity are in $m^2/s$, commonly converted to cSt or centistokes (1 cSt=10-6 $m^2/s$ or 1 cSt=1 $mm^2/sec$).

mPAO

In one embodiment, the mPAO used can be a co-polymer made from at least two alpha-olefins or more, or a homo-polymer made from a single alpha-olefin feed by a metallocene catalyst system.

This copolymer mPAO composition is made from at least two alpha-olefins of C3 to C30 range and having monomers randomly distributed in the polymers. In one embodiment, the average carbon number is at least 4.1. Ethylene and propylene, if present in the feed, can be present in the amount of less than 50 wt % individually or preferably less than 50 wt % combined. The copolymers can be isotactic, atactic, syndiotactic polymers or any other form of appropriate tacticity. These copolymers have useful lubricant properties including excellent VI, pour point, and low temperature viscometrics by themselves or as blend fluid with other lubricants or other polymers. Furthermore, these copolymers have narrow molecular weight distributions and excellent lubricating properties.

In another embodiment, mPAO is made from the mixed feed LAOs comprising at least two and up to 26 different LAOs selected from C3 to C30 linear alpha-olefins. In one embodiment, the mixed feed LAO is obtained from an ethylene growth process using an aluminum catalyst or a metallocene catalyst. The growth olefins comprise mostly C6 to C18-LAO. LAOs from other process can also be used.

This homo-polymer mPAO composition is made from single alpha-olefin choosing from C3 to C30 range, preferably C3 to C16, most preferably C3 to C14 or C3 to C12. The homo-polymers of the invention can be isotactic, atactic, syndiotactic polymers or any other form of appropriate tacticity. Often the tacticity can be carefully tailored by the polymerization catalyst and polymerization reaction condition chosen or by the hydrogenation condition chosen. These homo-polymers have useful lubricant properties including excellent VI, pour point, and low temperature viscometrics by themselves or as blend fluid with other lubricants or other polymers. Furthermore, these homo-polymers have narrow molecular weight distributions and excellent lubricating properties.

The activated metallocene catalyst can be simple metallocenes, substituted metallocenes or bridged metallocene catalysts activated or promoted by, for instance, methylaluminoxane (MAO) or a non-coordinating anion, such as N,N-dimethylanilinium tetrakis(perfluorophenyl)borate or other equivalent non-coordinating anion.

OSP (Oil Soluble Polyalkylene Glycols)

In one embodiment, OSP is defined as polyalkylene glycol's that can be miscible with common base oils. In this particular embodiment, OSP's are miscible with the alkyl aromatic chosen as part of the lubricating base stock.

It is theorized that polyalkylene glycol's that are miscible are those that typically have increased carbon to oxygen ratios. For example while butylene oxide is miscible in alkyl aromatics, tetrahydrofuran is more miscible than butylene oxide. Under this theory, styrene oxide would be more miscible than tetrahydrofuran and other higher alpha olefin oxides would be more miscible than styrene oxide.

In one embodiment the polyalkylene glycol can have a number average molecular weight of about 200 to about 8000, preferably about 500 to 5000. The polyaklyene glycol or derirative thereof can have a kinematic viscosity at 40° C. of about 15 to about 500 cSt, preferably of about 22 to about 500 cSt, more preferably of about 22 to about 370 cSt, and most preferably of about 22 to about 220 cSt.

In one embodiment the polyalkylene glycol represented by the following formula:

$$Z—(—(CHR_1—CHR_2—O)_n—R_3)_m$$

wherein Z is a residue of a non-amine initiator having from 1-8 active hydrogens, and $R_1$ and $R_2$ are independently H, or an alkyl. In one embodiment, the alkyl has from 1 to about 8 carbon atoms. In another embodiment, the alkyl is $CH_3$ or $CH_2$ $CH_3$. The integer n has a value from 8 to 25, preferably from 10 to 20. $R_3$ is H, an alkyl having from about 1 about 30 carbons, preferably from about 1 to about 24 carbons, more preferably from about 1 to about 12 carbons, and most preferably from about 1 to about 6 carbons, or an acyl having from about 1 to about 30 carbons, preferably from about 1 to about 24 carbons, more preferably from about 1 to about 12, and most preferably from about 1 to about 6 carbons, and m is from 1 to 8. In another embodiment, $R_1$ is H or $CH_3$ when $R_2$ is $CH_3$, and $R_2$ is H or $CH_3$ or $CH_2$ $CH_3$ when $R_1$ is H.

Although polyalkylene glycol's can be prepared in a number of ways, suitable examples are polyalkylene glycols prepared with initiators containing from 1-8 active hydrogens prepared from alkylene oxides having from 2 to about 12 carbons, including ethylene oxide, propylene oxide or butylene oxide. The oxides may be polymerized alone (homopolymers) or as mixtures (co- or tri-polymers). Another suitable polyalkylene glycol is prepared from a non-amine initiator having 1-4 active hydrogens, and having a kinematic viscosity at 40° C. of about 22 to about 220 cSt.

Composition

The lubricating composition can comprise the alkyl aromatic in a weight % from about 5 wt % to about 99 wt %. In some embodiments, the alkyl aromatic can range from about 50 wt % to about 90 wt %, about 55 wt % to about 80%, about 60 wt % to about 80 wt %, or even from about 65 wt % to about 78 wt %.

The lubricating composition can comprise the blend of additives in a weight % from about 0.005 wt % to about 10 wt %. In some embodiments, the blend of additives can range from about 0.5 wt % to about 7 wt %, about 0.5 wt % to about 5%, about 1 wt % to about 5 wt %, or even from about 1 wt % to about 2 wt %.

The lubricating composition can comprise oil soluble polyalkylene glycols or PAG's in a weight % from about 1 wt % to about 99 wt %. In some embodiments, the polyolefins or PAOs can range from about 5 wt % to about 60 wt %, about 5 wt % to about 50%, about 20 wt % to about 40 wt %, or even from about 30 wt % to about 40 wt %.

The lubricating composition can comprise the blend of polyolefins or PAOs in a weight % from about 5 wt % to about 99 wt %. In some embodiments, the polyolefins or PAOs can range from about 2 wt % to about 60 wt %, about 5 wt % to about 30%, about 10 wt % to about 20 wt %, or even from about 12 wt % to about 18 wt %.

The blend PAOs can also comprise a blend of mPAOs or a singular mPAO in an amount weight % amount ranging from about 0.25 wt % to about 10 wt % of the total lubricating composition. In some embodiments, the blend of mPAOs or the singular mPAO can range from about 0.5 wt % to about 7 wt %, about 1 wt % to about 5 wt %, about 1 wt % to about 3 wt %, about 0.5 wt % to about 2 wt %, or even from about 1 wt % to about 2 wt %.

The blend PAOs can also comprise a blend of conventional PAOs or a singular PAO in an amount weight % amount ranging from about 0.25 wt % to about 50 wt % of the total lubricating composition. In some embodiments, the blend of conventional PAOs or the singular PAO can range from about 0.5 wt % to about 30 wt %, about 1 wt % to about 20 wt %, about 5 wt % to about 15 wt %, about 1 wt % to about 10 wt %, or even from about 3 wt % to about 10 wt %.

The following examples of certain embodiments of the invention are given. Each example is provided by way of explanation of the invention, one of many embodiments of the invention, and the following examples should not be read to limit, or define, the scope of the invention.

To develop an understanding of the performance characteristics 20 different blends of lubricating compositions were made. Table 1, Table 2 and Table 3 depict the different blends in weight %:

TABLE 1

| Material | 1 | 2 | 3 | 4 | 5 | 6 | 7 | 8 |
|---|---|---|---|---|---|---|---|---|
| Base oil A | 35.98 | | | | | | | |
| Base oil B | 63.18 | | | | | | | |
| PAO | | | | | | | | 99.4 |
| Alkylated Naphthalene | | | 99.4 | 89.4 | 79.4 | 69.4 | 59.4 | |
| OSP A | | | | 10 | 20 | 30 | 40 | |
| OSP B | | 99.4 | | | | | | |
| Antioxidant A | 0.6 | 0.6 | 0.6 | 0.6 | 0.6 | 0.6 | 0.6 | 0.6 |
| Pour Point depressant | 0.2 | | | | | | | |
| Anti-foam | 0.04 | | | | | | | |

TABLE 2

| Material | 9 | 10 | 11 | 12 | 13 | 14 | 15 | 16 |
|---|---|---|---|---|---|---|---|---|
| Alkylated Naphthalene | | | | | 89.45 | 79.45 | 88.98 | 78.98 |
| OSP A | | | | | 10 | 20 | 10 | 20 |

TABLE 2-continued

| Material | 9 | 10 | 11 | 12 | 13 | 14 | 15 | 16 |
|---|---|---|---|---|---|---|---|---|
| OSP B | 99.45 | 98.95 | 98.45 | 94.95 | | | | |
| Antioxidant B | 0.25 | 0.5 | 0.75 | 1.0 | 0.25 | 0.25 | 0.5 | 0.5 |
| Antioxidant C | 0.25 | 0.5 | 0.75 | 1.0 | 0.25 | 0.25 | 0.5 | 0.5 |
| Corrosion Inhibitor | 0.05 | 0.05 | 0.05 | 0.05 | 0.05 | 0.05 | 0.05 | 0.05 |

TABLE 3

| Material | 17 | 18 | 19 | 20 |
|---|---|---|---|---|
| Alkylated Naphthalene | 77.45 | 67.45 | 76.95 | 66.95 |
| OSP A | 10 | 20 | 10 | 20 |
| PAO | 10 | 10 | 10 | 10 |
| mPAO A | | 2 | | 2 |
| mPAO B | 2 | | 2 | |
| Antioxidant B | 0.25 | 0.25 | 0.50 | 0.5 |
| Antioxidant C | 0.25 | 0.25 | 0.50 | 0.5 |
| Corrosion Inhibitor | 0.05 | 0.05 | 0.50 | 0.05 |

Five different tests were run after the development of the lubricating composition. For some of the tests additional samples were tested. Kinetic viscosity tests were run at both 40° C. and 100° C. Additional tests include viscosity index, acid number test, membrane patch colorimetery (MPC) and rotation pressure vessel oxidation test (RPVOT). MPC tests show the ability to control varnish and are typically below 15. The industry rating scale for the MPC tests is 0-15 normal (new oil value), 15-30 monitor (slight potential to form varnish), 30-40 abnormal (increased tendency to form varnish), and >40 critical(high tendency to form varnish).

The test results are shown in Table 4, Table 5 and Table 6.

TABLE 4

| Test | 1 | 2 | 3 | 4 | 5 | 6 | 7 | 8 |
|---|---|---|---|---|---|---|---|---|
| cSt @ 40° C. | 32.15 | 31.15 | 27.48 | 29.37 | 31.21 | 33.23 | 35.36 | 30.32 |
| cSt @ 100° C. | 5.46 | 6.10 | 4.67 | 5 | 5.35 | 5.71 | 6.1 | 5.78 |
| Viscosity Index | 105 | 147 | 84 | 94 | 104 | 112 | 119 | 136 |
| Acid Number (new) | 0.09 | 0.09 | 0.09 | 0.13 | 0.12 | 0.1 | 0.08 | 0.16 |
| MPC (new) | <0.5 | 0.7 | 0.7 | 0.7 | 0.7 | 0.6 | 0.6 | 0.5 |
| RPVOT, Avg. | 1800 | 212.6 | 2599.3 | 1154.4 | 649.9 | 532 | 484.8 | 2387 |

TABLE 5

| Test | 9 | 10 | 11 | 12 | 13 | 14 | 15 | 16 |
|---|---|---|---|---|---|---|---|---|
| cSt @ 40° C. | 31.41 | 31.85 | 32.28 | 32.66 | 29.52 | 31.45 | 29.75 | 31.79 |
| cSt @ 100° C. | 6.14 | 6.16 | 6.19 | 6.22 | 5.02 | 5.37 | 5.04 | 6.39 |
| Viscosity Index | 147 | 145 | 144 | 143 | 93 | 104 | 93 | 103 |
| Acid Number (new) | 0.06 | <0.05 | <0.05 | <0.05 | <0.05 | <0.05 | <0.05 | <0.05 |
| MPC (new) | 0.3 | 0.4 | 0.4 | 0.4 | 0.6 | 0.6 | 0.7 | 0.7 |
| RPVOT, Avg. | 712 | 1347 | 1389 | 1134 | 1684 | 1383 | 1744 | 1881 |

TABLE 6

| Test | 17 | 18 | 19 | 20 |
|---|---|---|---|---|
| cSt @ 40° C. | 31.41 | 32.58 | 31.69 | 32.92 |
| cSt @ 100° C. | 5.43 | 5.67 | 5.45 | 5.69 |
| Viscosity Index | 108 | 114 | 107 | 113 |

TABLE 6-continued

| Test | 17 | 18 | 19 | 20 |
|---|---|---|---|---|
| Acid Number (new) | 0.09 | 0.15 | <0.05 | <0.05 |
| RPVOT, Avg. | 1616 | 1285 | 1910 | 1839 |

The lubricating composition was then subjected to a long term oxidation test where four different complete temperature cycles lasting a total of 672 hours with a cycle being a minimum temperature of 60° C. for 96 hours and a maximum temperature of 150° C. for 72 hours were done. The tests run on the lubricating composition after the long term oxidation test was % change of the kinetic viscosity test, acid number increase, % oil loss, MPC, and RPVOT retention %.

TABLE 7

| Long-Term Test | 1 | 2 | 3 | 4 | 5 | 6 | 7 | 8 |
|---|---|---|---|---|---|---|---|---|
| cSt @ 40° C. % change | 2.40 | −34.21 | 5.85 | 7.13 | 7.18 | 7.19 | 4.47 | 0.96 |
| cSt @ 100° C. % change | 1.63 | −32.63 | 3.34 | 3.73 | 3.26 | 1.28 | −1.35 | 0.78 |
| Acid Number, Increase | 0.10 | >8.5 | 0.37 | 0.49 | 0.82 | 2.10 | 2.89 | 0.00 |
| Oil Loss, % | 0.8 | 11.00 | 1.51 | 0.82 | 1.08 | 1.41 | 1.63 | 0.49 |
| MPC | 27.7 | 4.7 | 7.1 | 7.3 | 7.4 | 7.8 | 8 | 20.5 |
| RPVOT, Retention % | 7.13 | 7.49 | 44.67 | 16.18 | 3.95 | 3.54 | 3.55 | 48.61 |

TABLE 8

| Long-Term Test | 9 | 10 | 11 | 12 | 13 | 14 | 15 | 16 |
|---|---|---|---|---|---|---|---|---|
| cSt @ 40° C. % change | −31.14 | −5.56 | 4.18 | 4.47 | 6.98 | 7.19 | 9.58 | 2.55 |
| cSt @ 100° C. % change | −24.99 | −3.28 | 4.17 | 4.42 | 4.32 | 4.66 | 5.94 | −0.93 |
| Acid Number, Increase | 6.26 | 1.32 | 0.49 | 0.49 | 0.05 | 0.25 | 0.34 | 0.38 |
| Oil Loss, % | 13.26 | 2.91 | 1.08 | 1.08 | 1.25 | 1.41 | 1.86 | 1.28 |
| MPC | 37.7 | 15.4 | 18.1 | 13.6 | 16.1 | 13.5 | 15.8 | 14.3 |
| RPVOT, Retention % | 2.08 | 1.21 | 21.1 | 76.69 | 44.47 | 15.84 | 60.6 | 58.08 |

TABLE 9

| Long-Term Test | 17 | 18 | 19 | 20 |
|---|---|---|---|---|
| cSt @ 40° C. % change | 6.23 | 6.49 | 8.27 | 8.14 |
| cSt @ 100° C. % change | 3.55 | 3.88 | 5.07 | 5.19 |
| Acid Number, Increase | 0.31 | 0.29 | 0.44 | 0.42 |
| Oil Loss, % | 1.2 | 1.3 | 1.4 | 1.3 |
| MPC | 11.3 | 11.2 | 14 | 9.2 |
| RPVOT, Retention % | 34.1 | 16.0 | 75.6 | 58.3 |

In closing, it should be noted that the discussion of any reference is not an admission that it is prior art to the present invention, especially any reference that may have a publication date after the priority date of this application. At the same time, each and every claim below is hereby incorporated into this detailed description or specification as an additional embodiment of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. A lubricating base stock comprising:

a) an alkyl aromatic;

b) a blend of additives;

c) a blend of oil soluble polyalkylene glycols, wherein the amount of oil soluble polyalkylene glycols range from about 5 wt % to about 50 wt %, wherein the oil soluble polyaklyene glycols are homopolymers of ethylene oxide, and the blend of oil soluble polyalkylene glycols increase the viscosity index, of the lubricating base stock, with the oil soluble polyalkylene glycols having a number average molecular weight of about 200 to about 8000; and d) a blend of polyolefins, wherein the blend of polyolefins comprises at least one metallocene polyolefin and wherein the lubricating base stock has a membrane patch colorimetry value below 15 after a long-term oxidation test, an acid number increase below 0.44 after a long-term oxidation test and a viscosity index greater than 107, wherein the long-term oxidation test consists of subjecting the composition to four different complete temperature cycles lasting a total of 672 hours with a cycle being a minimum temperature of 60° C. for 96 hours and a maximum temperature of 150° C. for 72 hours.

2. The lubricating base stock of claim 1, wherein the amount of alkyl aromatic ranges from about 50 wt % to about 95 wt %.

3. The lubricating base stock of claim 1, wherein the amount of additives range from about 0.005 wt % to about 5 wt %.

4. The lubricating base stock of claim 1, wherein the amount of polyolefins range from about 10 wt % to about 20 wt %.

5. The lubricating base stock of claim 1, wherein the alkyl aromatic has one or more alkyl groups from about 6 to about 30 carbon atoms.

6. The lubricating base stock of claim 1, wherein the additives are selected from the group consisting of: antioxidants, corrosion inhibitors, rust inhibitors, antiwear, extreme pressure, demulsifiers, and anti-foam.

7. The lubricating base stock of claim 1, wherein the blend of polyolefins comprises at least three different types of polyolefins.

8. The lubricating base stock of claim 1, wherein the blend of polyolefins comprises at least one oil soluble polyolefin and at least one metallocene polyolefin.

9. The lubricating base stock of claim 1, wherein the amount of oil soluble polyolefin is greater than the amount of metallocene poly olefin.

10. A lubricating base stock comprising:

a) an alkyl aromatic ranging from about 50 wt % to about 95 wt %;

b) blend of additives ranging from about 0.005 wt % to about 5 wt %;

c) a blend of oil soluble polyalkylene glycols from about 5 wt % to about 50 wt %, wherein the oil soluble polyaklyene glycols are homopolymers of ethylene oxide, and the blend of oil soluble polyalkylene glycols increase the viscosity index, of the lubricating base stock, with the oil soluble polyalkylene glycols having a number average molecular weight of about 200 to about 8000;

and d) a blend of polyalphaolefins ranging from about 10 wt % to about 20 wt % wherein the blend of polyalphaolefins comprise at least two different types of polyalphaolefins comprising: at least one metallocene polyalphaolefin and wherein the lubricating base stock has a membrane patch colorimetry value below 15 after a long-term oxidation test, an acid number increase below 0.44 after a long-term oxidation test and a viscosity index greater than 107, wherein the long-term oxidation test consists of subjecting the composition to four different complete temperature cycles lasting a total of 672 hours with a cycle being a minimum temperature of 60° C. for 96 hours and a maximum temperature of 150° C. for 72 hours.

11. A method of manufacturing a lubricating base stock comprising the mixing of:

a) an alkyl aromatic;

b) a blend of additives;

c) a blend of oil soluble polyalkylene glycols and the blend of oil soluble polyalkylene glycols increase the viscosity index, of the lubricating base stock, with the oil soluble polyalkylene glycols having a number average molecular weight of about 200 to about 8000, and wherein the oil soluble polyaklyene glycols are homopolymers of ethylene oxide; and d) a blend of polyolefins, wherein the blend of polyolefins comprises at least one metallocene polyolefin and wherein the lubricating base stock has a membrane patch colorimetry value below 15 after a long term oxidation test, an acid number increase below 0.44 after a long-term oxidation test and a viscosity index greater than 107, wherein the long-term oxidation test consists of subjecting the composition to four different complete temperature cycles lasting a total of 672 hours with a cycle being a minimum temperature of 60° C. for 96 hours and a maximum temperature of 150° C. for 72 hours.

12. The method of claim 11, wherein the amount of alkyl aromatic ranges from about 50 wt % to about 95 wt %.

13. The method of claim 11, wherein the amount of additives range from about 0.005 wt % to about 5 wt %.

14. The method of claim 11, wherein the amount of polyolefins range from about 10 wt % to about 20 wt %.

15. The method of claim 11, wherein the amount of oil soluble polyalkylene glycols range from about 5 wt % to about 50 wt %.

16. The method of claim 11, wherein the alkyl aromatic has one or more alkyl groups from about 6 to about 30 carbon atoms.

17. The method of claim 11, wherein the lubricating base stock is used as a turbine oil.

18. A method of manufacturing a lubricating base stock comprising the mixing of:

a) an alkyl aromatic ranging from about 50 wt % to about 95 wt %;

b) blend of additives ranging from about 0.005 wt % to about 5 wt %;

c) a blend of oil soluble polyalkylene glycols from about 5 wt % to about 50 wt %, wherein the oil soluble polyaklyene glycols are homopolymers of ethylene oxide, and the blend of oil soluble polyalkylene glycols increase the viscosity index, of the lubricating base stock, with the oil soluble polyalkylene glycols having a number average molecular weight of about 200 to about 8000;

and d) a blend of polyalphaolefins ranging from about 10 wt % to about 20 wt % wherein the blend of polyalphaolefins comprise at least two different types of polyalphaolefins comprising: at least one metallocene polyalphaolefin, and the lubricating base stock has a membrane patch colorimetry value below 15 after a long-term oxidation test, an acid number increase below 0.44 after a long-term oxidation test and a viscosity index greater than 107, wherein the long-term oxidation test consists of subjecting the composition to four different complete temperature cycles lasting a total of 672 hours with a cycle being a minimum temperature of 60° C. for 96 hours and a maximum temperature of 150° C. for 72 hours.

* * * * *